US009395137B2

(12) United States Patent
Miller, III et al.

(10) Patent No.: US 9,395,137 B2
(45) Date of Patent: Jul. 19, 2016

(54) FLASH SUPPRESSING MUZZLE BRAKE

(71) Applicant: Spike's Tactical, LLC, Apopka, FL (US)

(72) Inventors: Thomas James Miller, III, Lehigh Acres, FL (US); Maxwell Lowther, Naples, FL (US); Adam Nicklos, Felda, FL (US)

(73) Assignee: Spike's Tactical, LLC, Apopka, FL (US)

( * ) Notice: Subject to any disclaimer, the term of this patent is extended or adjusted under 35 U.S.C. 154(b) by 0 days.

(21) Appl. No.: 14/719,861

(22) Filed: May 22, 2015

(65) Prior Publication Data

US 2016/0033224 A1 Feb. 4, 2016

Related U.S. Application Data

(60) Provisional application No. 62/008,696, filed on Jun. 6, 2014.

(51) Int. Cl.

| | |
|---|---|
| ***F41A 21/00*** | (2006.01) |
| ***F41A 21/36*** | (2006.01) |
| ***F41A 21/34*** | (2006.01) |

(52) U.S. Cl.

CPC ..... *F41A 21/36* (2013.01); *F41A 21/34* (2013.01)

(58) Field of Classification Search

USPC ..... 89/14.2, 14.3; 42/1.06

See application file for complete search history.

(56) References Cited

U.S. PATENT DOCUMENTS

| | | | | |
|---|---|---|---|---|
| 2,112,831 | A * | 4/1938 | Cutts, Jr. | F41A 21/34 89/14.3 |
| 4,024,790 | A | 5/1977 | Heiderer | |
| 5,596,161 | A | 1/1997 | Sommers | |
| 7,594,464 | B2 * | 9/2009 | Dueck | F41A 21/30 89/14.2 |
| 7,789,009 | B1 * | 9/2010 | Brittingham | F41A 21/30 181/223 |
| 7,836,809 | B2 | 11/2010 | Noveske | |
| 8,047,115 | B2 | 11/2011 | Noveske | |
| 8,186,261 | B2 | 5/2012 | McNeill et al. | |
| 2010/0257996 | A1 | 10/2010 | Noveske | |
| 2011/0094371 | A1 | 4/2011 | Noveske | |
| 2011/0252952 | A1 * | 10/2011 | McNeill | F41A 21/38 89/14.3 |
| 2013/0233162 | A1 * | 9/2013 | Schneider | F41A 13/12 89/14.3 |
| 2015/0323276 | A1 * | 11/2015 | Myers | F41A 21/30 89/14.3 |

* cited by examiner

*Primary Examiner* — J. Woodow Eldred
(74) *Attorney, Agent, or Firm* — Wood Herron & Evans LLP

(57) ABSTRACT

A flash-suppressing muzzle brake for a firearm has a body defining a substantially cylindrical inner chamber and an open front end. A conical element is received in the inner chamber and has an open front end and a rear end that defines a conical bore. A mounting element has threads adapted to mate with threads on the body and an interior surface that receives the front end of the conical element. A first flash chamber is situated at the rear end of the conical element and has circumferentially-spaced openings and a central passageway providing fluid communication between the first flash chamber and the conical bore. A second flash suppression chamber is defined by the external surface of the conical element, the cylindrical interior surface portion of the body, and the rear portion of the body. Radial openings allow fluid communication of muzzle gases between the first and second flash chambers.

10 Claims, 4 Drawing Sheets

FLASH SUPPRESSING MUZZLE BRAKE

RELATED APPLICATION

This application claims priority to and the benefit of U.S. Provisional Patent Application No. 62/008,696 filed Jun. 6, 2014.

FIELD OF THE INVENTION

This invention relates to a device, attachable at the muzzle of a firearm barrel, for reducing muzzle flash and counteracting recoil as a muzzle brake.

BACKGROUND OF THE INVENTION

Muzzle brakes or recoil compensators are known, which redirect propellant gases to counter recoil when a firearm is fired. Likewise, a flash suppressor is a known device attached to the muzzle of a rifle that reduces its visible signature while firing by cooling or dispersing the burning gases that exit the muzzle, a phenomenon more often associated with carbine length weapons. A number of different flash suppressing designs have been used over the years. The simplest is a cone placed on the muzzle end of the barrel, which was used during World War II on jungle-combat versions of the Lee-Enfield, No. 5 variant, or the M1 Carbine. Pronged or birdcage type flash suppressors have also been used, which radially disperse burning gases rapidly exiting the muzzle.

Another type of flash suppressor, which may also aid in reliability by increasing back pressure, is patterned after the Krinkov brake found on the Soviet AK74SU submachine gun. The Krinkov brake provides an expansion chamber with a cone-shaped exit nozzle. Other later devices, such as the KX3 flash suppressor sold by Noveske Rifleworks, LLC of Grants Pass, Oreg., have rearranged the Krinkov brake to position a chamber around the cone, shortening the overall length of the muzzle device.

The present invention is intended to improve the flash suppression and braking performance over these designs.

SUMMARY OF THE INVENTION

Disclosed is a flash-suppressing muzzle brake for a firearm having a body that defines a substantially cylindrical inner chamber. The body has a rear end portion configured for attachment to a muzzle of a firearm and an internally threaded interior surface at an open front end. A conical element is received in the inner chamber and has an open front end and a rear end. The conical element defines a conical bore having first diameter at the front end and a smaller second diameter at the rear end. The conical element has a tapered external surface portion rearward of the front end. A mounting element has external threads adapted to mate with the internally threaded interior surface of the body and an interior surface adapted to receive the front end of the conical element. A first flash chamber is located at the rear end of the conical element and is defined by a wall extending rearwardly from the conical bore to engage the rear end portion of the body. The first flash chamber wall has circumferentially-spaced openings and a central passageway axially aligned with and providing fluid communication between the first flash chamber and the conical bore. A second flash suppression chamber is defined by the tapered external surface of the conical element, the cylindrical interior surface portion of the body, and the rear portion of the body. The radial openings allow fluid communication of muzzle gases between the first and second flash chambers.

According to other aspects on the invention, the circumferentially-spaced openings in the first flash chamber wall may be longitudinally elongated and/or helically oriented. The elongated openings may extend to a rear edge of the first flash chamber wall.

A forward end of the first flash chamber may include a rearwardly-facing annular wall around the central passageway that provides a muzzle blast impact surface. An interior surface of the rear end portion of the body can include a recess to receive a portion of the first flash chamber wall. The mounting element can include a crenellated front surface around the open front end of the conical element and the mounting element can include exterior threads that are exposed for attachment of another member when the mounting element is fully engaged with the body.

The mounting element can include a crenellated front surface around the open front end of the conical element and further comprise a cover member having internal threads adapted to mate with the exposed external threads of the mounting element and configured to cover the crenellated front surface of the mounting element. A glass break attachment member having internal threads adapted to mate with the exposed external threads of the mounting element may also be provided.

Other aspects, benefits, and features of the present invention may be apparent to a person of skill in this art by reference to the following specification, drawing figures, and claims, all of which are part of the disclosure of the invention.

BRIEF DESCRIPTION OF THE DRAWING

Like reference numerals are used to indicate like parts throughout the various figures of the drawing, wherein.

DETAILED DESCRIPTION

Figure 1:
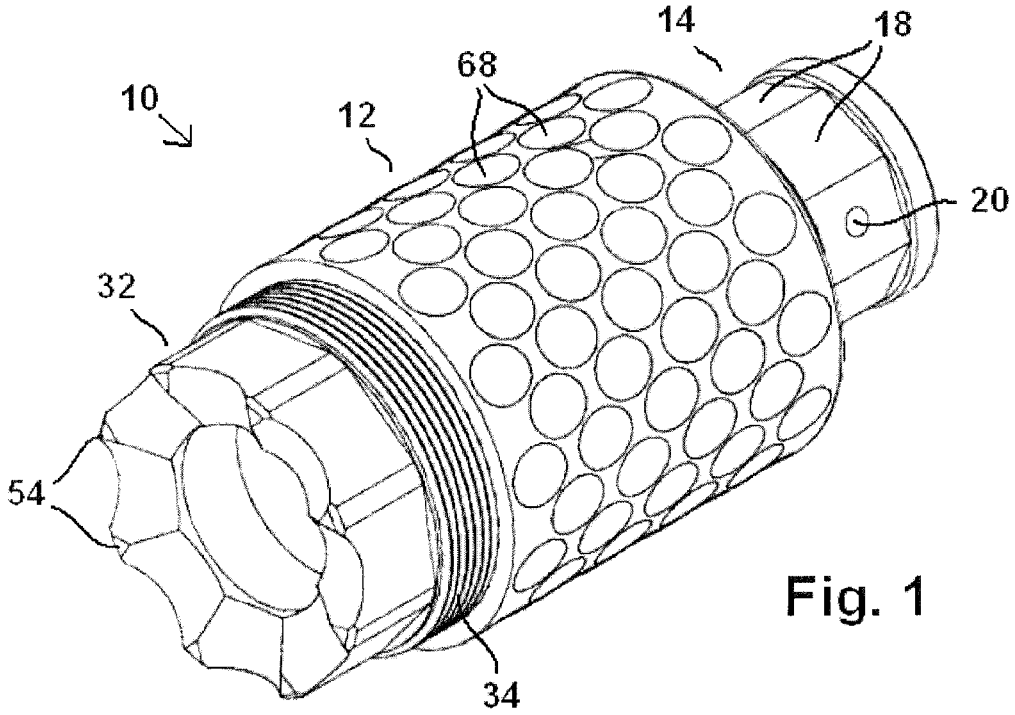
FIG. 1 is an isometric view of an embodiment of the present invention.

Referring to the various figures of the drawing, and first to FIGS. 1-6, therein is shown at 10 a flash suppressing muzzle brake device of the present invention. The device 10 includes a substantially cylindrical main body housing 12 with a rear end portion 14 adapted to be secured, such as by threading, pinning, or welding, onto the muzzle of a firearm barrel 16 (shown in FIG. 6). The rear portion 14 may be internally threaded to match threads provided at the muzzle end of a barrel 16 and may include wrench flats 18 to facilitate tightening the main body housing 12 to the threaded connections. If desired, a blind-end socket 20 may be provided to receive a pin (not shown) that may be inserted and welded to provide a permanent attachment of the device 10 to the barrel 16. Alternately, a common set screw (not shown) may be provided to lock the threaded engagement.

Figure 5:
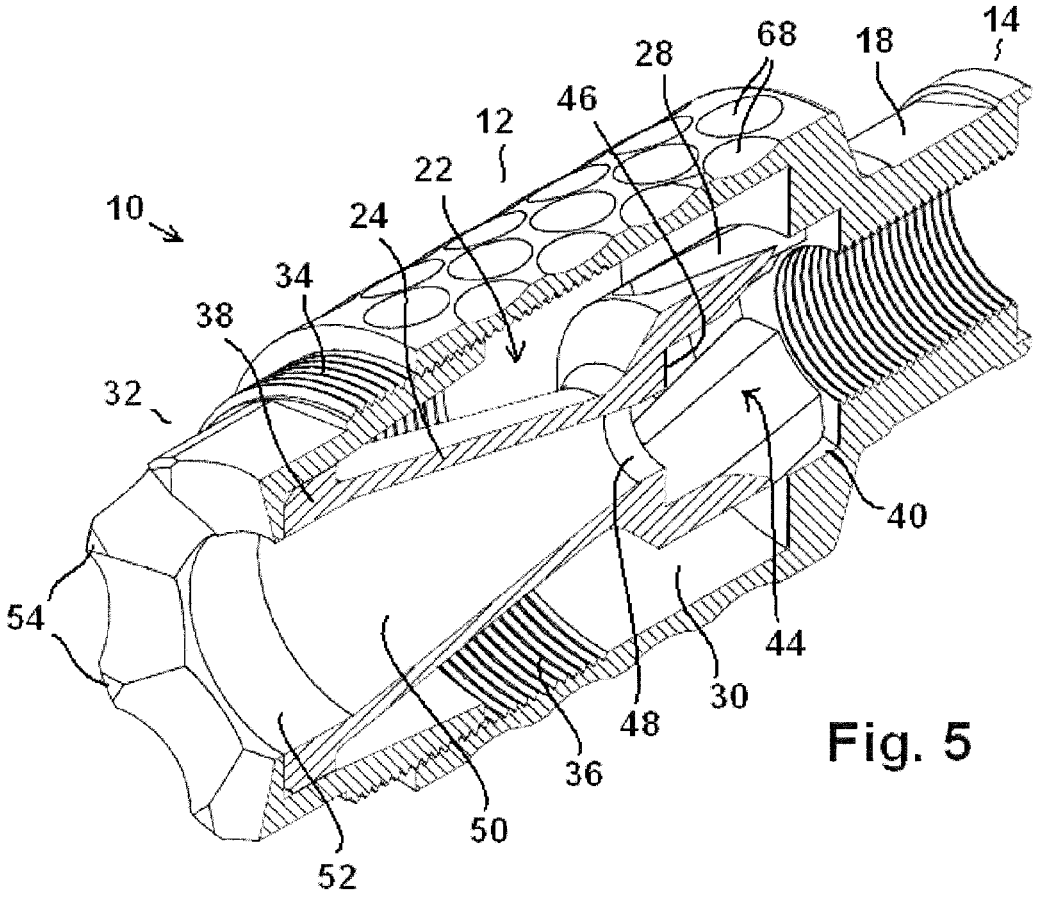
FIG. 5 is a view similar to FIG. 1, shown in longitudinal section.
Figure 2:
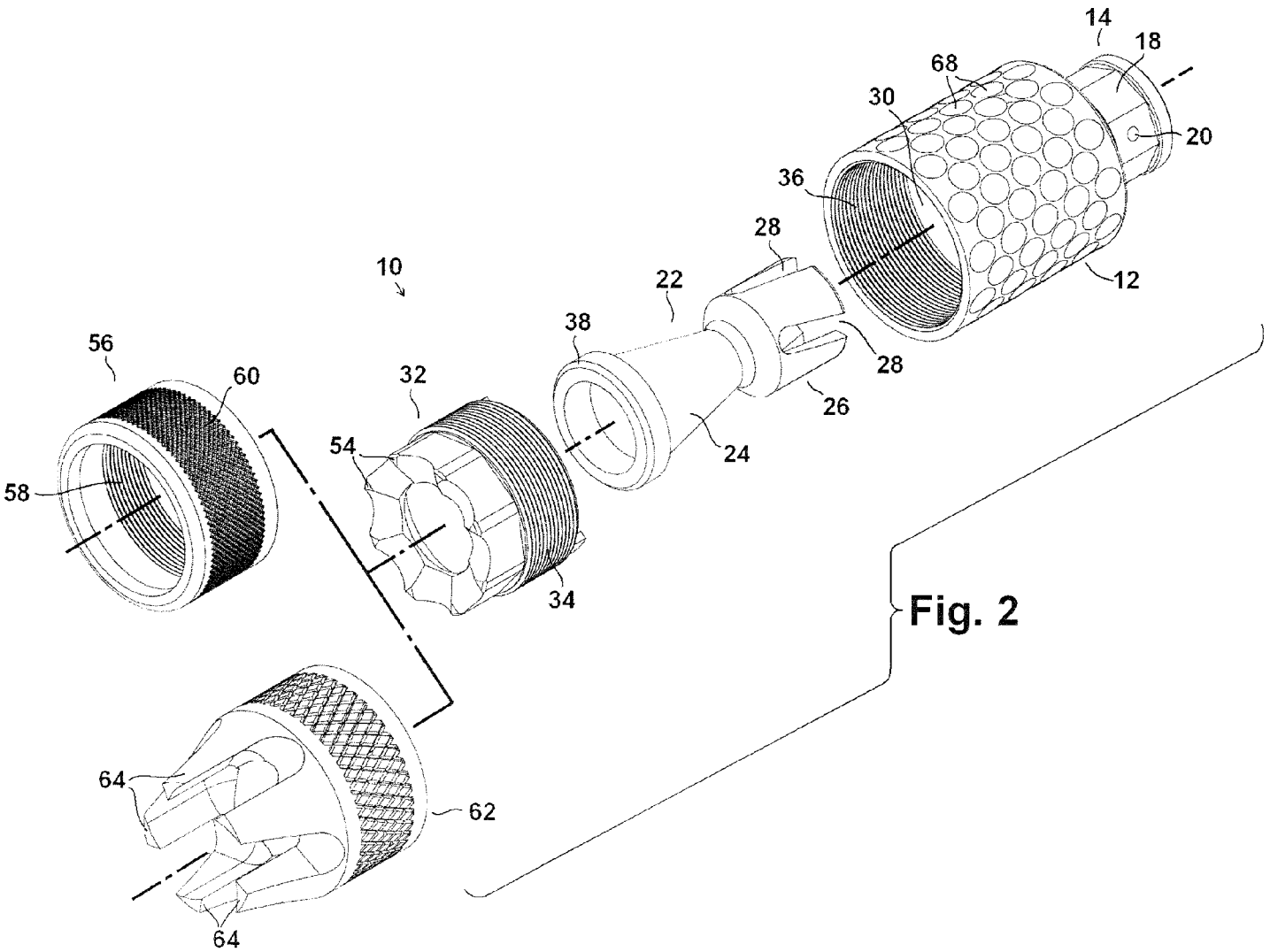
FIG. 2 is an exploded isometric view of the device showing a protective ring and a glass break attachment that can attached to the forward end of the device.
Figure 3:
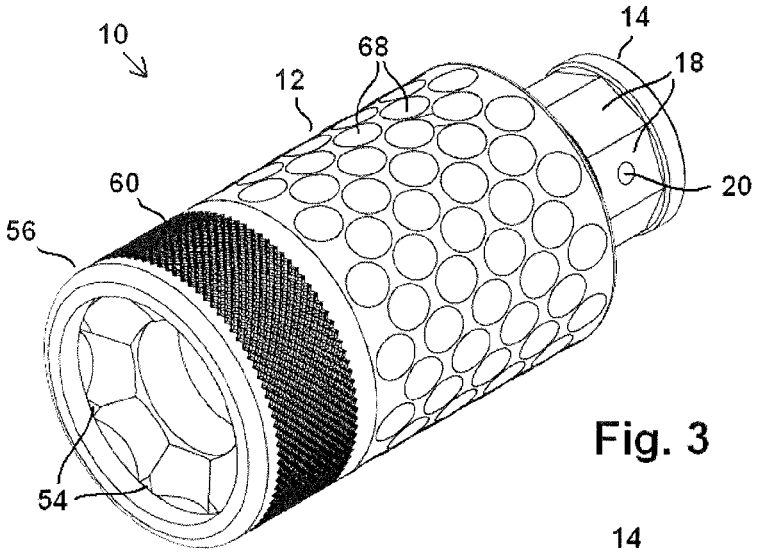
FIG. 3 is an isometric view showing the protective ring attached.
Figure 4:
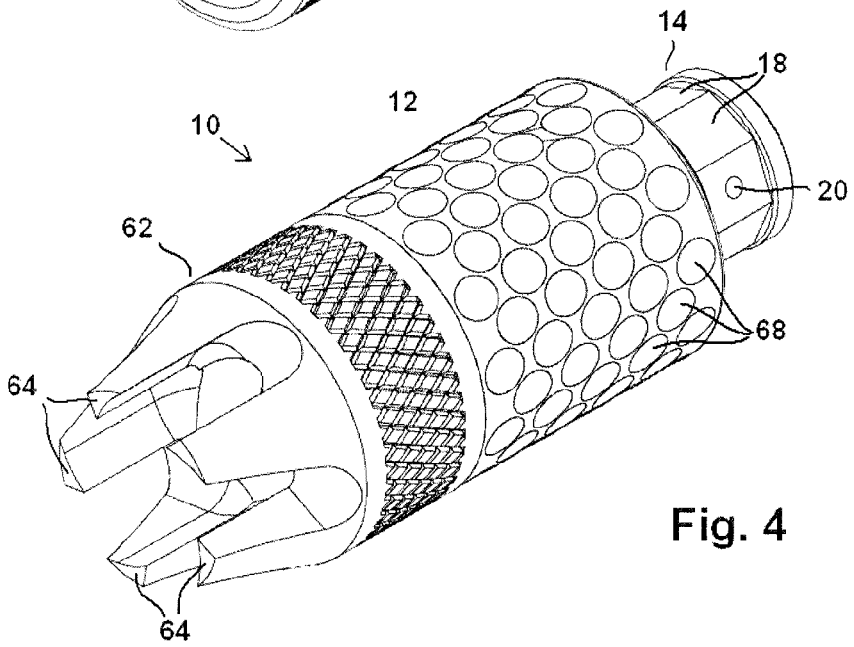
FIG. 4 is an isometric view showing the glass break attachment installed.
Figure 6:
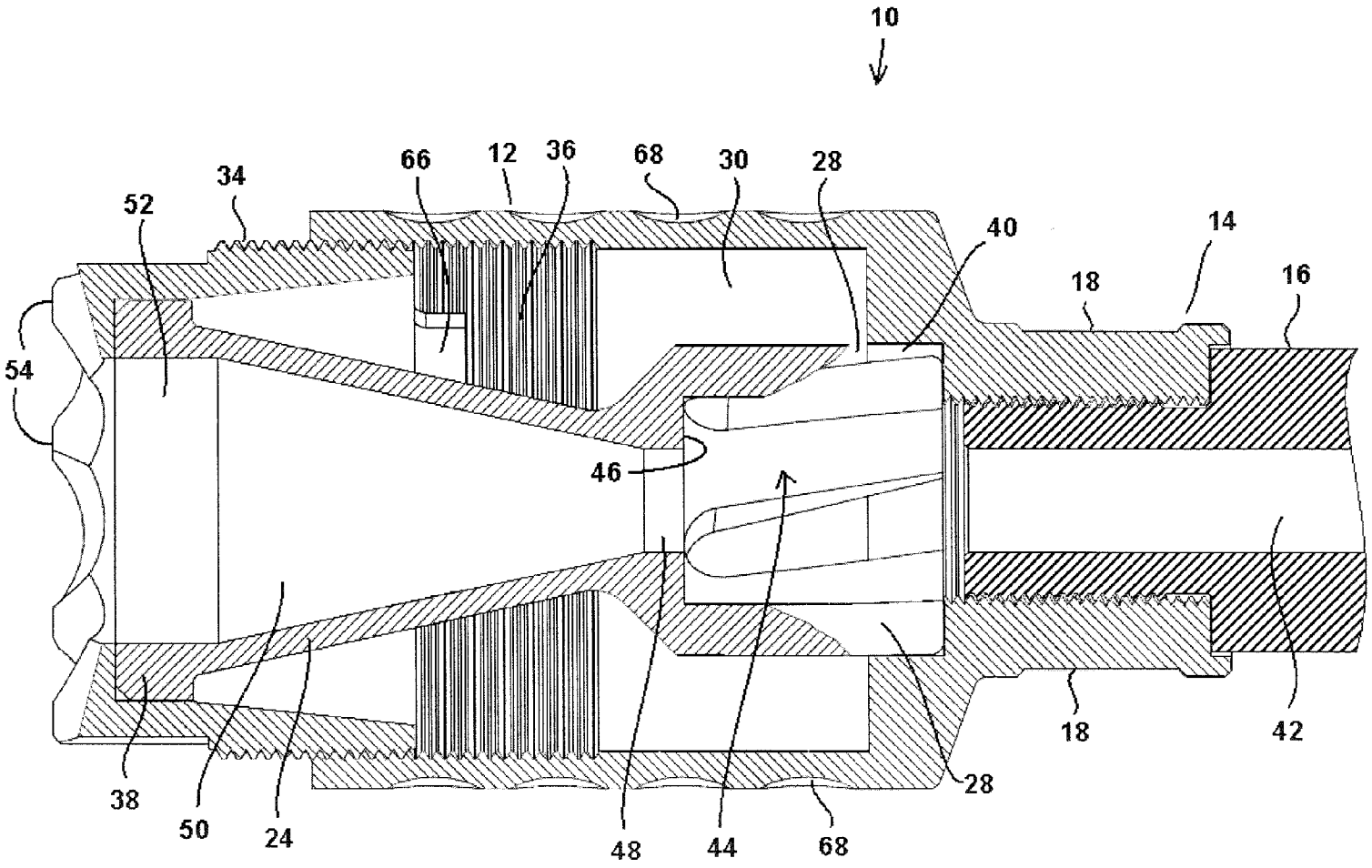
FIG. 6 is a side plan view shown in longitudinal section and attached to the muzzle portion of a barrel.

The device 10 includes an inner body member 22 having a substantially conical forward portion 24 and a rearwardly-extending wall portion 26 provided with a plurality of elongated radial ports 28. The inner body member 22 is held in place in an inner chamber 30 of the main body housing 12 by a front mounting member 32. When assembled, an inner chamber 30 is defined by the main body housing 12, the exterior of the inner body member 22, and the front mounting member 32, as best seen in FIGS. 5 and 6.

The front mounting member 32 may include a series of external threads 34 configured to match a series of internal threads 36 on the interior of the main body housing 12. The front cover member 32 is configured on the inside to receive and support a forward rim 38 of the cone portion 24. The main body housing 12 may also include an internal annular recess 40 adjacent the rear end portion 14 to receive the wall portion 26 of the inner body member 22. When the front mounting member 32 is threaded into engagement with the main body housing 12, the inner body member 22 is secured in compression therebetween, as shown in FIG. 6. Specifically, the inner body member 22, provides a passageway axially aligned with the bore 42 of the firearm barrel 16 when mounted. At the rear wall portion 26 of the inner body member 22 there is a chamber area 44 into which a projectile and propulsion gasses enter as they first exit the muzzle of the firearm barrel 16. The first chamber area 44 includes a plurality of radial ports 28 which control the rapidly expanding and high pressure gases being ported into the main chamber 30 of the main body housing 12. At least a portion of the muzzle blast impacts a rearward facing annular wall 46 at the forward end of the first chamber area 44. The radial ports 28 may be in the form of elongated slots, which, if desired, may extend substantially the full axial length of the rear portion 26 and be opened at the rearward-most end. Also if desired, the position of the elongated radial ports 28 may be angled or helically configured in the direction of rotation of the exiting projectile. For example, the helical orientation of the radial ports 28 may be made to correspond with the twist rate and direction of the rifling (not shown) in the bore 42 of the firearm barrel 16. The high pressure flow of gasses passing through the radial ports 28 into the inner or main chamber 30 of the main body housing 12 impact forward walls of that chamber 30 to partially counteract the recoil forces of the firearm.

Forward of the first chamber area 44 and in axial alignment with the bore 42 of the barrel 16, is a passageway 48 that is sized to be only slightly larger in diameter than the projectile to be fired from the barrel 16. Preferably, the passageway 48 diameter is kept as small as practical, while avoiding possible contact by the advancing projectile. Forward of the passageway 48 is the conical portion 24 of the inner body member 22 defining a substantially conical chamber 50 with a fully open forward end 52. As high velocity gases pass through the central passageway 48 and enter the conical chamber 50, the stream is pulled toward the conical interior walls by the Coanda Effect (the tendency of a fluid stream to be attracted to a nearby surface). This causes the high velocity stream of gases to expand rapidly in cross-sectional area, which results in a corresponding rapid drop in fluid stream pressure and dissipation of the burning gasses that cause muzzle flash.

The forward end of the front cover member 32 may be made with an annular series of spikes 54, which provide a crenellated strike surface on the muzzle device 10. If desired, a front cover ring 56 may be provided to cover the spikes 54 to guard against inadvertent contact with or injury to nearby persons or objects. The cover ring 56 may be internally threaded 58 to correspond with the external threads 34 of the front cover member 32. Also if desired, at least a portion of the exterior surface of the front cover ring 56 may be provided with knurling 60 to facilitate grip when removing. Alternatively, a glass brake attachment 62 may be threaded on to the front cover member 32. The glass brake attachment 62 provides one or more forwardly-extending elongated tines 64 with hardened, sharp ends that can be used as an impact tool.

Figure 7:
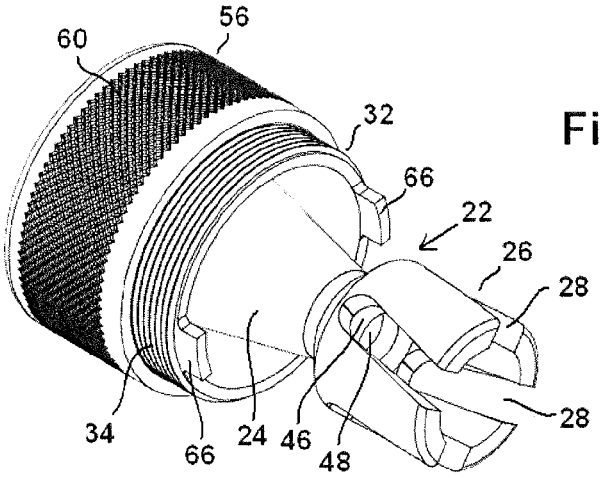
FIG. 7 is a rear isometric view of the inner body member and front cover member with the protective ring attached.

Referring now in particular to FIG. 7, if desired, the rearward edge of the front mounting member 32 may be provided with one or more tabs 66 or notches (not shown) to provide grip in the event the external threads 34 of the front cover member 32 become stuck with the internal threads 58 of the front cover ring 56 (shown) or the glass brake attachment 62 (not shown).

Also if desired, a series of dimples 68 or depressions may be formed over at least a portion of the outer surface of the main body housing 12 in order to increase the surface area for enhanced heat dissipation.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. A flash-suppressing muzzle brake for a firearm, comprising:

a body defining a substantially cylindrical inner chamber, the body having a rear end portion configured for attachment to a muzzle of a firearm and an internally threaded interior surface at an open front end;

a conical element received in the inner chamber and having an open front end and a rear end, the conical element defining a conical bore having first diameter at the front end, and a smaller second diameter at the rear end, the conical element having a tapered external surface portion rearward of the front end;

a mounting element having external threads adapted to mate with the internally threaded interior surface of the body and an interior surface adapted to receive the front end of the conical element;

a first flash chamber at the rear end of the conical element defined by a wall extending rearwardly from the conical bore to engage the rear end portion of the body, the first flash chamber wall having circumferentially-spaced openings therein and a central passageway axially aligned with and providing fluid communication between the first flash chamber and the conical bore; and a second flash suppression chamber defined by the tapered external surface of the conical element, by the cylindrical interior surface portion of the body, and by the rear portion of the body, the radial openings allowing fluid communication of muzzle gases between the first and second flash chambers.

2. The flash suppressing muzzle brake of claim 1, wherein the circumferentially-spaced openings in the first flash chamber wall are longitudinally elongated.

3. The flash suppressing muzzle brake of claim 2, wherein the elongated openings are helically oriented.

4. The flash suppressing muzzle brake of claim 3, wherein the elongated openings extend to a rear edge of the first flash chamber wall.

5. The flash suppressing muzzle brake of claim 1, wherein a forward end of first flash chamber includes a rearwardly-facing annular wall around the central passageway, the annular wall providing a muzzle blast impact surface.

6. The flash suppressing muzzle brake of claim 1, wherein an interior surface of the rear end portion of the body includes a recess to receive a portion of the first flash chamber wall.

7. The flash suppressing muzzle brake of claim 1, wherein the mounting element includes a crenellated front surface around the open front end of the conical element.

8. The flash suppressing muzzle brake of claim 1, wherein the mounting element includes exterior threads that are exposed for attachment of another member when the mounting element is fully engaged with the body.

9. The flash suppressing muzzle brake of claim 8, wherein the mounting element includes a crenellated front surface around the open front end of the conical element and further comprising a cover member having internal threads adapted to mate with the exposed external threads of the mounting element and configured to cover the crenellated front surface of the mounting element.

10. The flash suppressing muzzle brake of claim 8, further comprising a glass break attachment member having internal threads adapted to mate with the exposed external threads of the mounting element.

* * * * *